US007776116B2

(12) United States Patent
Oh et al.

(10) Patent No.: US 7,776,116 B2
(45) Date of Patent: Aug. 17, 2010

(54) CYCLONE DUST-SEPARATING APPARATUS OF VACUUM CLEANER

(75) Inventors: Jang-keun Oh, Gwangju (KR); Min-ha Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 458 days.

(21) Appl. No.: 11/903,930

(22) Filed: Sep. 25, 2007

(65) Prior Publication Data

US 2008/0256911 A1 Oct. 23, 2008

(30) Foreign Application Priority Data

Apr. 17, 2007 (KR) ..... 10-2007-0037532

(51) Int. Cl.
*B01D 45/12* (2006.01)

(52) U.S. Cl. ..... 55/345; 55/348; 55/429; 55/457; 55/459.1

(58) Field of Classification Search ..... 55/343, 55/345, 348, 429, 457, 459.1, DIG. 3
See application file for complete search history.

(56) References Cited

U.S. PATENT DOCUMENTS 4,280,825 A 7/1981 Marjollet et al.
4,435,877 A 3/1984 Berfield
6,350,292 B1 2/2002 Lee
7,326,268 B2 * 2/2008 Oh et al. ..... 55/343
2005/0252179 A1 11/2005 Oh

FOREIGN PATENT DOCUMENTS

GB 2344778 A 6/2000
KR 1020000067145 A 11/2000
KR 1020020072009 A 9/2002
KR 2004-113347 4/2004

OTHER PUBLICATIONS

Extended European Search Report for corresponding European Patent Application No. 07291529.1 dated Mar. 26, 2010.

* cited by examiner

*Primary Examiner*—Robert A Hopkins
(74) *Attorney, Agent, or Firm*—Ohlandt, Greeley, Ruggiero & Perle, LLP

(57) ABSTRACT

A cyclone dust-separating apparatus of a vacuum cleaner is disclosed. The cyclone dust-separating apparatus includes at least one cyclone having a cyclone body, which rotates air to separate dust or dirt therefrom, which has an air inflow part and an air discharging part, and which is installed in such a manner that a longitudinal axis thereof is substantially horizontally arranged, and a dust collecting unit to store the dust or dirt separated by the cyclone unit. The cyclone body is formed in a convex cylinder shape, so that a diameter thereof in the vicinity of an entrance of the air discharging part through which the air is discharged comes maximum.

19 Claims, 12 Drawing Sheets

CYCLONE DUST-SEPARATING APPARATUS OF VACUUM CLEANER

CROSS-REFERENCE TO RELATED APPLICATIONS

This application claims the benefit under 35 U.S.C. §119 (a) of Korean Patent Application No. 10-2007-0037532, filed on Apr. 17, 2007, in the Korean Intellectual Property Office, the entire content of which is hereby incorporated by reference.

BACKGROUND OF THE INVENTION

1. Field of the Invention

The present disclosure relates to a vacuum cleaner. More particularly, the present disclosure relates to a cyclone dust-separating apparatus of a vacuum cleaner, which draws in external air and then separates dust or dirt therefrom.

2. Description of the Related Art

In general, a cyclone dust-separating apparatus provided in a vacuum cleaner is an apparatus, which whirls air laden with dirt or dust and separates the dirt or dust therefrom. Such a cyclone dust-separating apparatus has been recently widely used because it can be semi-permanently used without any inconvenience of having to frequently replace dust bags.

As disclosed in U.S. Pat. No. 6,350,292, a cyclone dust-separating apparatus usually has a cyclone unit vertically and elongately installed, a cyclone body with an air inflow part and an air discharging part formed at a side and a top thereof, respectively, and a dust collecting unit connected to a bottom part of the cyclone unit. Accordingly, external air is drawn in through the side of the cyclone body and lowered while being swirled therein, and dirt or dust removed from the air is collected in the collecting unit. However, such a conventional cyclone dust-separating apparatus requires forming the dust collecting unit in a relatively small size because the cyclone unit has large height. As a result, the conventional cyclone dust-separating apparatus is inconvenient to use, in that the dirt or dust collected in the dust collecting unit should be frequently emptied.

To address the problem as described above, in recent, a cyclone dust-separating apparatus in which a cyclone body is horizontally installed to allow a dust collecting unit to have a larger height or size is actively being developed. Such a cyclone dust-separating apparatus is advantageous in that since it can enlarge a volume of the dust collecting unit, it addresses the problem that dirt or dust collected in the dust collecting unit should be frequently emptied. However, in the cyclone dust-separating apparatus, there is a problem that since the cyclone body is formed in a cylinder shape, the diameter of which is uniform in a longitudinal direction thereof, air increases its flowing speed when it is discharged through an air discharging part of the cyclone body after flowing into the cyclone body. Such an increase in the flowing speed of the air at the air discharging part not only increases a pressure loss, but also an operating noise. The increase in the pressure loss may increase an output of a suction motor of the vacuum cleaner, which is required to obtain the same dust-separating efficiency, thereby causing the vacuum cleaner to use more power.

SUMMARY OF THE INVENTION

An aspect of the present disclosure is to address at least the above problems and/or disadvantages and to provide at least the advantages described below. Accordingly, an aspect of the present disclosure is to provide a cyclone dust-separating apparatus having a reduced operating noise and a reduced pressure loss.

In accordance with an aspect of the present disclosure, a cyclone dust-separating apparatus includes at least one cyclone having a cyclone body, which rotates air to separate dust or dirt therefrom, which has an air inflow part and an air discharging part, and which is installed in such a manner that a longitudinal axis thereof is substantially horizontally arranged, and a dust collecting unit to store the dust or dirt separated by the cyclone unit. The cyclone body is formed in a convex cylinder shape, so that a diameter thereof in the vicinity of an entrance of the air discharging part through which the air is discharged is a maximum diameter.

Here, the cyclone body may be formed, so that at least two convex cylinder portions, the diameters of which are gradually increased, are joined with each other. At this time, the two convex cylinder portions may be formed to have the same lengths or different lengths in a direction of longitudinal axis thereof.

Alternatively, the cyclone body may be formed, so that at least one linear cylinder portion, the diameter of which is uniform, and at least one convex cylinder portion, the diameter of which are gradually varied, are joined with each other. At this time, the two cylinder portions may be formed to have the same lengths or different lengths in a direction of longitudinal axis thereof.

In addition, the air inflow part may be formed in a tangential inlet shape through which the air are flowing into the cyclone body while coming in contact directly with an inner circumferential surface of the cyclone body, a helical inlet shape through which the air approaches in the form of a spiral toward one end surface of the cyclone body from an outside of the one end surface of the cyclone body and then flows into the cyclone body, while coming in contact with the inner circumferential surface of the cyclone body, or an involute inlet shape through which the air is gradually approached in the form of a volute toward an outer circumferential surface of the cyclone body from an outside of the outer circumferential surface of the cyclone body and then flows into the cyclone body while coming in contact with the inner circumferential surface of the cyclone body.

Also, the at least one cyclone may include a plurality of cyclones disposed in parallel, or a plurality of cyclones disposed in a radial direction.

BRIEF DESCRIPTION OF THE DRAWING FIGURES

The above and other objects, features, and advantages of certain exemplary embodiments of the present disclosure will be more apparent from the following description taken in conjunction with the accompanying drawings, in which.

Throughout the drawings, the same reference numerals will be understood to refer to the same elements, features, and structures.

DETAILED DESCRIPTION OF THE EXEMPLARY EMBODIMENTS

Hereinafter, a cyclone dust-separating apparatus of a vacuum cleaner according to certain exemplary embodiments of the present disclosure will be described in detail with reference to the accompanying drawing figures.

Figure 1:
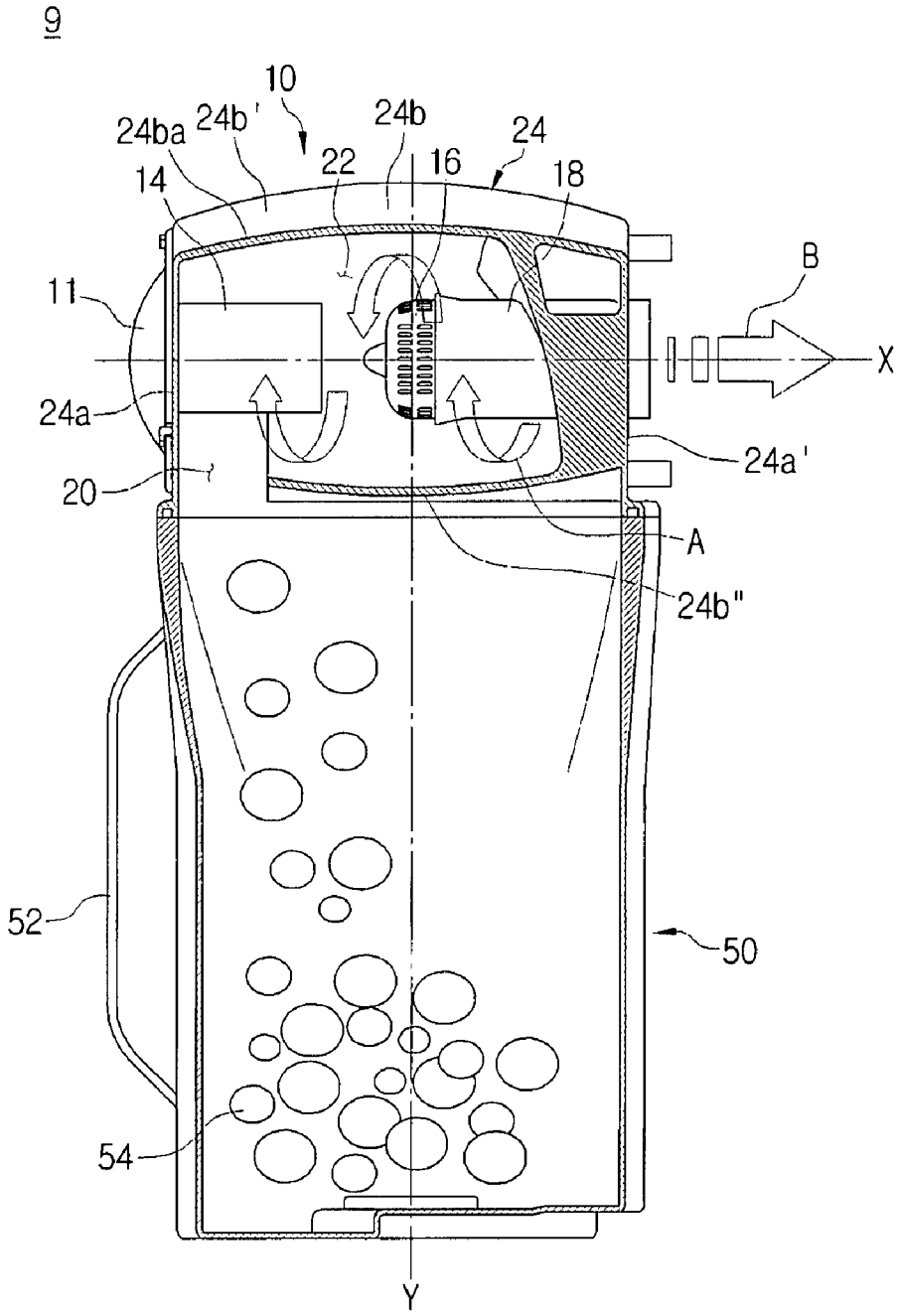
FIG. 1 is a cross-sectional view exemplifying a cyclone dust-separating apparatus of a vacuum cleaner according to a first exemplary embodiment of the present disclosure.

FIG. 1 exemplifies a cyclone dust-separating apparatus 9 of a vacuum cleaner according to a first exemplary embodiment of the present disclosure.

Referring to FIG. 1, the cyclone dust-separating apparatus 9 according to the first exemplary embodiment of the present disclosure includes a cyclone 10 and a dust collecting unit 50.

Figure 2:
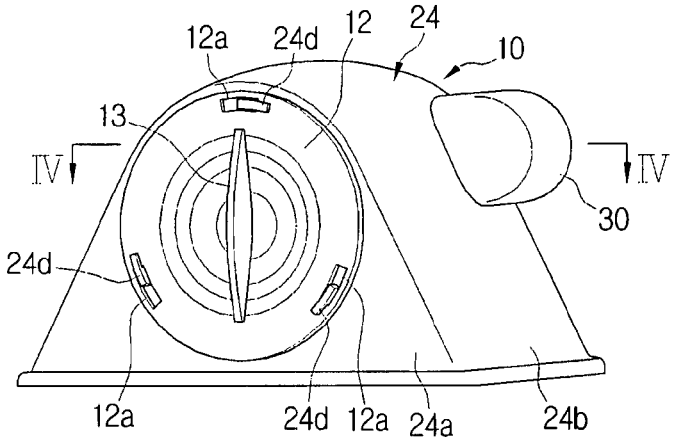
FIG. 2 is a perspective view exemplifying a cyclone of the cyclone dust-separating apparatus illustrated in FIG. 1.
Figure 3:
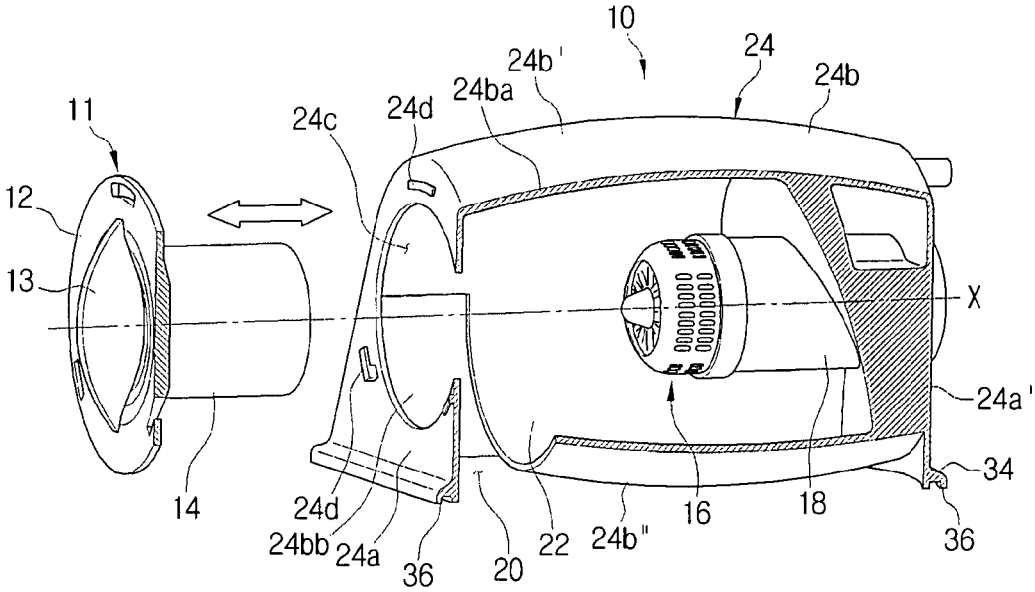
FIG. 3 is a partially cut-away and exploded perspective view of the cyclone of the cyclone dust-separating apparatus illustrated in FIG. 2.

As illustrated in FIGS. 2 and 3, the cyclone 10 is provided with a cyclone body 24, a guide unit 11, a filter 16, an outflow pipe 18 and an inflow pipe 30. In addition, the cyclone 10 horizontally extends, so that external air is horizontally drawn thereinto and horizontally discharged therefrom. That is, the cyclone 10 is arranged in such a manner that its longitudinal axis is an X-axis or extends substantially in the horizontal direction, as illustrated in FIG. 3.

The cyclone body 24 is made up of opposite end surfaces 24*a* and 24*a*', each of which is formed in a triangular shape with a rounded top apex, and a body part 24*b* interconnecting the opposite end surfaces 24*a* and 24*a*'. One end surface 24*a* is provided with a mounting opening 24*c* in which the guide unit 11 is mounted, and the other end surface 24*a*' is provided with the outflow pipe 18, which extends into the inside of the body part 24*b*, as an air discharging part through which dust-removed air can be discharged. Because the outflow pipe 18 extends parallel to the X-axis in the horizontal direction, an air outlet 26 (see FIG. 4) through which the air is discharged is also formed in the horizontal direction. In addition, an inflow pipe 30 through which external air is drawn in projects from the body part 24*b*.

As illustrated in FIG. 3, the body part 24*b* is made up of an outer portion 24*b*' and an inner portion 24*b*". The outer portion 24*b*', which forms an appearance of the cyclone 10, has an upper surface 24*ba* and a lower surface 24*bb*. The upper surface 24*ba* defines an upper part of a cyclone chamber 22. The inner portion 24*b*" is connected with the upper surface 24*ba* inside the lower surface 24*bb* of the outer portion 24*b*', so that it defines a lower part of the cyclone chamber 22.

Figure 4:
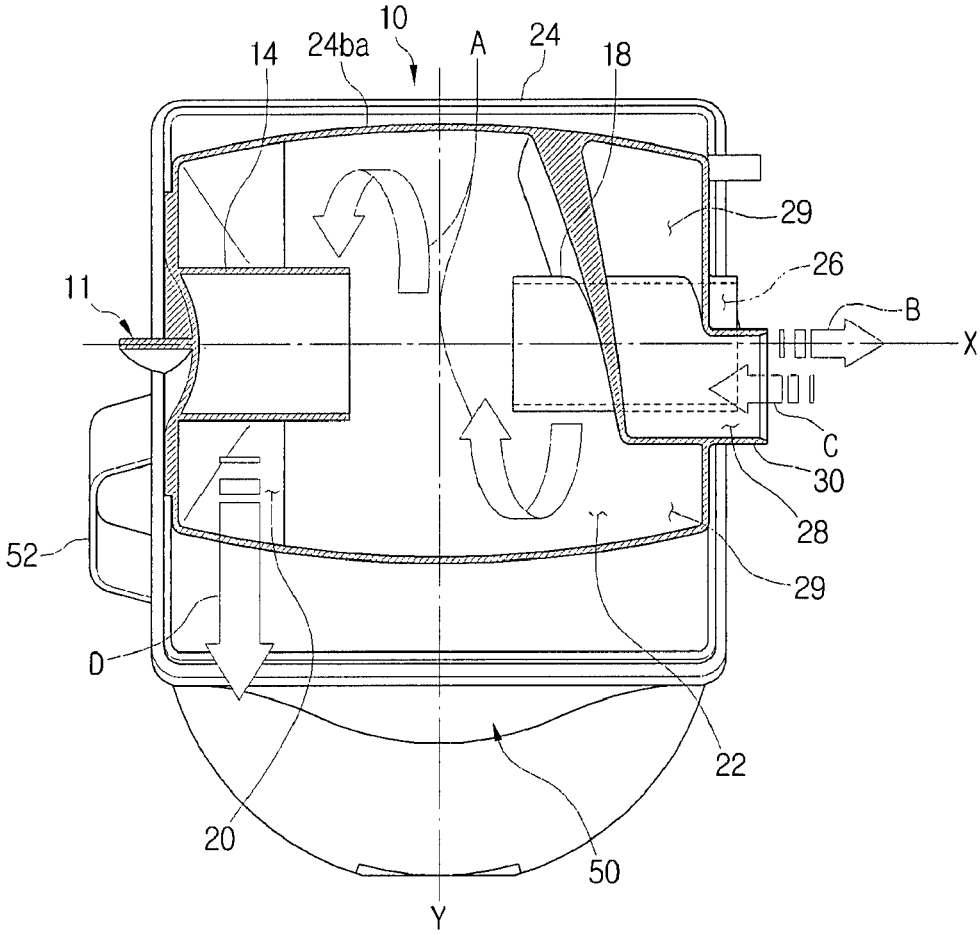
FIG. 4 is a partially cut-away perspective view of the cyclone dust-separating apparatus illustrated in FIG. 1, which is taken along line IV-IV of FIG. 2.

As illustrated in FIGS. 1 and 4, the inner portion 24*b*" and the upper surface 24*ba* of the outer portion 24*b*' of the body part 24*b* are formed in a convex cylinder shape. That is, the inner portion 24*b*" and the upper surface 24*ba* can be formed in a shape of two convex cylinder portions, the diameters of which are gradually increased from the opposite end surfaces 24*a* and 24*a*' to the middle (a Y axis of the drawings) of the body part 24*b* of the cyclone body 24, respectively, are joined to be symmetrized to each other on the middle (the Y axis of the drawings) of the body part 24*b*. Here, the reason why the two convex cylinder portions are joined at the middle (the Y axis of the drawings) of the body part 24*b* is to maximize a diameter of the body part 24*b* in the vicinity of an entrance of the outflow pipe 18 so as to counterbalance a flow of the air, which severely flows at the entrance of the outflow pipe 18 through which the air is discharged. Alternatively, provided that the diameter of the body part 24*b* in the vicinity of the entrance of the outflow pipe 18 is maximized, the body part 24*b*, that is, the inner portion 24*b*" and the upper surface 24*ba* may be formed in a shape that two convex cylinder portions having different lengths in a direction of longitudinal axis thereof are joined to each other. For example, an embodiment of the upper surface 24*ba* formed in a shape that two convex cylinder portions having different lengths in a direction of longitudinal axis thereof are joined to each other is illustrated in FIG. 5C, which shows a body part 24*b*'" in a cyclone body 24'". With this configuration of the body part 24*b*, the air that flows into and moves into the cyclone chamber 22 does not generates a sudden change in the flow in the vicinity of the entrance of the outflow pipe 18. As a result, a flowing speed of the air discharged through the air outlet 26 of the outflow pipe 18 is decreased, and thus an operating noise and a pressure loss of the vacuum cleaner are reduced. Such a decrease in the pressure loss reduces an output of a suction motor (not illustrated) of the vacuum cleaner, which is required to obtain the same dust-separating efficiency, thereby allowing the vacuum cleaner to use less power.

According to an experiment of the applicant of using the cyclone dust-separating apparatus 9 according to the first exemplary embodiment of the present disclosure constructed as described above, as illustrated in the following table 1, a good result was obtained in the pressure loss, as compared with an example of the conventional cyclone dust-separating apparatus. In the experiment, an amount of operating fluid was 1.3 CMM (cubic meter per minute) and input dust was a dimethyl terephthalate (DMT) 08.

TABLE 1

| | Embodiment of present disclosure | Example of conventional apparatus |
|---|---|---|
| Efficiency (%) | 95.45 | 95.4 |
| Pressure loss (mm of water) | 132 | 150 |

As apparent from the table 1, in the embodiment of present disclosure, the dust-separating efficiency was similar, but the pressure loss was reduced by approximately 10% (approximately 18 mm of water), as compared with the example of conventional apparatus.

Figure 5A:
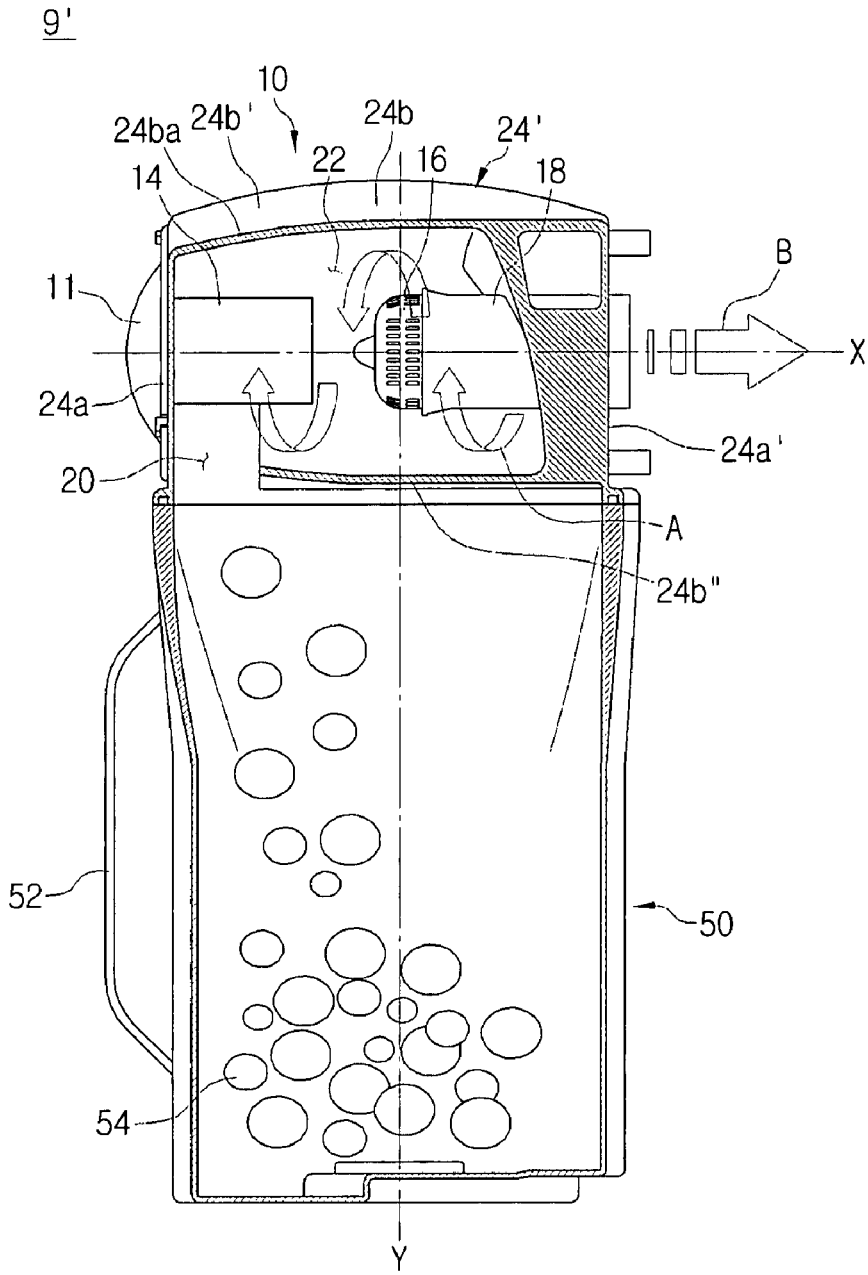
FIGS. 5A through 5D are cross-sectional views exemplifying additional examples of a cyclone body of the cyclone of the cyclone dust-separating apparatus.
Figure 5B:
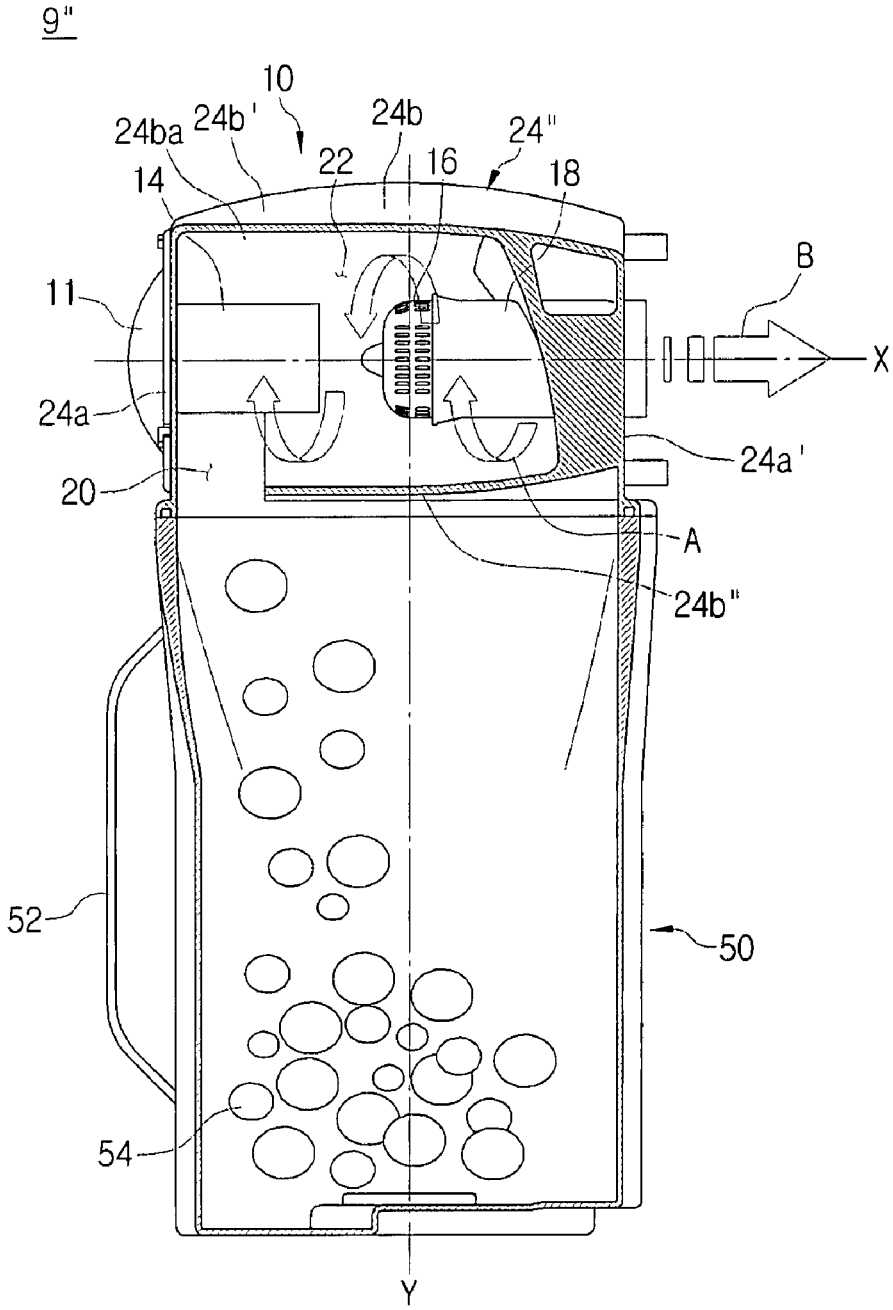
Figure 5C:
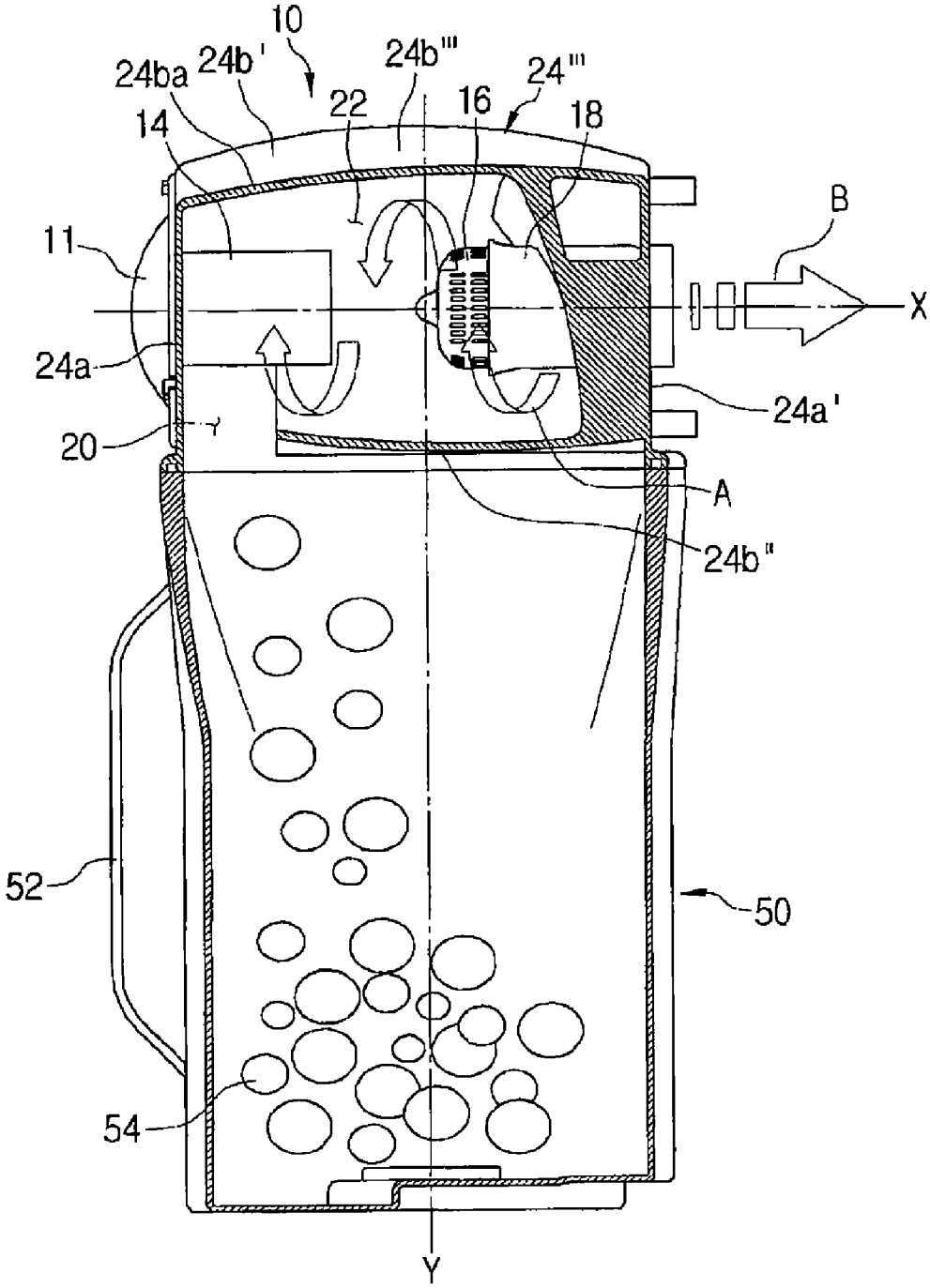

Alternatively, as in a cyclone dust-separating apparatus 9' illustrated in FIG. 5A, a cyclone body 24' can be configured, so that the inner portion 24*b*" and the upper surface 24*ba* of the outer portion 24*b*' of the body part 24*b* are formed in a shape that a convex cylinder portion, the diameter of which is gradually increased from the one end surface 24*a* of the cyclone body 24' to the middle (the Y axis of the drawing) of the body part 24*b* of the cyclone body 24', and a linear cylinder portion, the diameter of which is uniform from the middle (the Y axis of the drawing) of the body part 24*b* to the other end surface 24*a*' of the cyclone body 24', are joined at the middle (the Y axis of the drawing) of the body part 24*b*. Also, as in a cyclone dust-separating apparatus 9" illustrated in FIG. 5B, a cyclone body 24" can be configured, so that the inner portion 24*b*" and the upper surface 24*ba* of the outer portion

24*b*' of the body part 24*b* are formed in a shape that a linear cylinder portion, the diameter of which is uniform from the one end surface 24*a* of the cyclone body 24" to the middle (the Y axis of the drawing) of the body part 24*b* of the cyclone body 24", and a convex cylinder portion, the diameter of which is gradually decreased from the middle (the Y axis of the drawing) of the body part 24*b* to the other end surface 24*a*' of the cyclone body 24", are joined at the middle (the Y axis of the drawing) of the body part 24*b*.

Figure 5D:
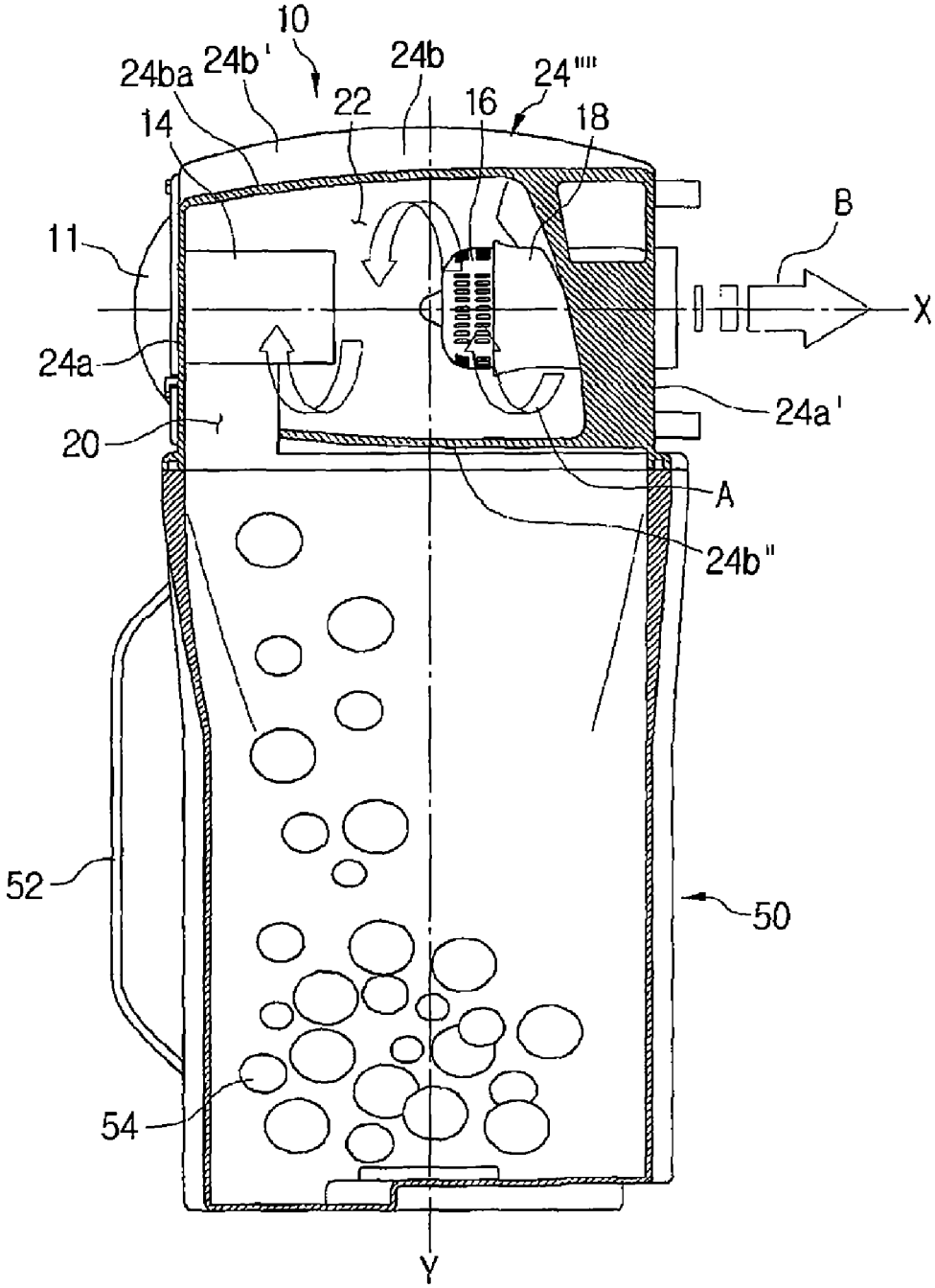

Here, although each of the cyclone bodies 24' and 24" is illustrated and explained as formed in the shape that the convex cylinder portion and the linear cylinder portion are joined at the middle (the Y axis of the drawings) of the body part 24*b*, it can be also configured as in the cyclone body 24"" illustrated in FIG. 5D, so that the diameter of the body part 24*b* in the vicinity of the entrance of the outflow pipe 18 is maximized like the cyclone bodies 24, a convex cylinder portion and a linear cylinder portion having different lengths in the direction of longitudinal axis thereof and thus it is made up of the convex cylinder portion and the linear cylinder portion, which are joined with each other at a point or place besides the middle (the Y axis of the drawings) of the body part 24*b*.

Referring again to FIG. 3, the cyclone body 24 has an extended part 34 extended around lower ends of the opposite end surfaces 24*a* and 24*a*' thereof and a lower end of the outer portion 24*b*' of the body part 24*b* thereof to form an elongated groove 36 into which a top end of the dust collecting unit 50 can be inserted. A sealing member (not shown) is inserted into the elongated groove 36 so as to seal a gap between the dust collecting unit 50 and the cyclone body 24. A dust discharge port 20 is formed at a side of the inner portion 24*b*" of the body part 24*b* of the cyclone body 24, so that internal spaces of the cyclone chamber 22 and the dust collecting unit 50 are communicated with each other and thus dirt or dust separated from the air drops into the dust collecting unit 50. The dust discharge port 20 is formed in a circumferential direction of the inner portion 24*b*" of the body part 24*b* below a guide pipe 14.

The guide unit 11 is mounted in the mounting opening 24*c* so as to penetrate through one end surface 24*a* of the cyclone body 24. The guide unit 11 has a knob 12 and a guide pipe 14, wherein three locking holes 12*a* are formed in the knob 12 in a circumferential direction of the knob 12 and a handle 13 is projected from the center of the knob 12 so as to be capable of being gripped by a user. Locking projections 24*d* projecting from the one end surface 24*a* of the cyclone body 24 are inserted into the locking holes 12*a*, respectively, so that the guide unit 11 is fixed to the cyclone body 24. The guide pipe 14 is connected to a side of the knob 12 and extends into the inside of the cyclone body 24. The guide unit 11 can be mounted in or removed from the cyclone body 24 merely by rotating the handle 13 of the knob 12.

The filter 16 is removably mounted on an end, that is, the entrance, of the outflow pipe 18, and air drawn into the inside of the cyclone body 24 is discharged to the outside via the outflow pipe 18 after separating dirt or dust therefrom through the filter 16. In the present embodiment, the filter 16 is formed of a grill member with a plurality of through-holes. In the cyclone 10, the guide pipe 14 and the outflow pipe 18 are substantially horizontally arranged.

Referring to FIG. 1, the dust collecting unit 50 has a very large volume as compared with that of the cyclone unit 10 and is vertically arranged, so that the Y-axis is a longitudinal axis thereof and thus the longitudinal axis thereof is perpendicular or substantially perpendicular to the longitudinal axis of the cyclone unit 10. The dust collecting unit 50 is removably coupled to a bottom end of the cyclone unit 10 and has a handle 52 at a side thereof, so that a user can grip the dust collecting unit 50 thus to mount or remove it.

Referring to FIGS. 2 and 4, the inflow pipe 30, as an air inflow part to draw in the external air into the cyclone chamber 22, is provided on the upper surface 24*ba* of the outer portion 24*b*' of the body part 24*b* in the same direction as that of the outflow pipe 18 and is projected from a side of the body part 24*b* of the cyclone body 24 in such a manner that an air inlet 28 through which the air is drawn in is formed in the horizontal direction.

Figure 6A:
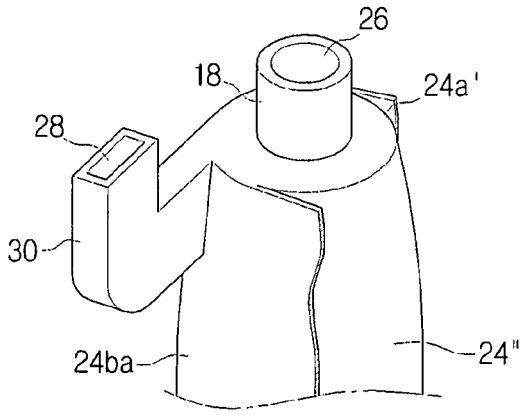
FIGS. 6A, 6B and 6C are partially cut-away perspective views exemplifying examples of an inflow pipe of the of the cyclone body of the cyclone illustrated in FIG. 2.

Also, as illustrated in FIG. 6A, preferably, but not necessarily, the inflow pipe 30 is formed in a tangential inlet shape through which the drawn-in air flows into the cyclone chamber 22 of the cyclone body 24 while coming in contact directly with an inner circumferential surface of the upper surface 24*ba* of the outer portion 24*b*' of the body part 24*b*.

Figure 6B:
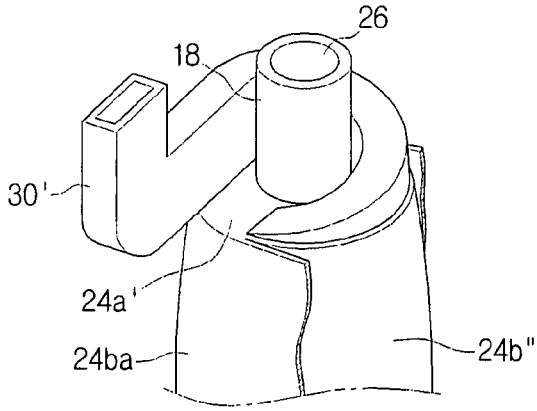
Figure 6C:
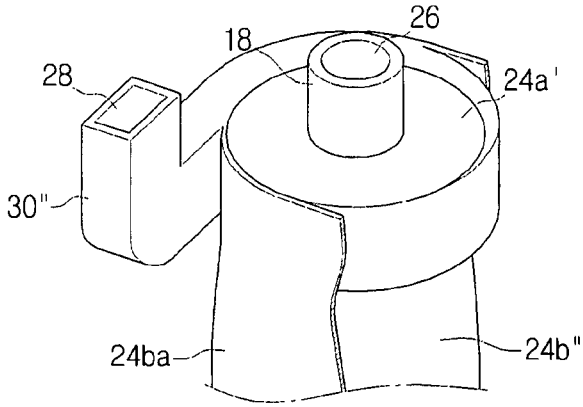

Alternatively, as illustrated in FIGS. 6B and 6C, an inflow pipe 30' or 30" can be formed in a helical inlet shape (see FIG. 6B) through which the air is gradually approached in the form of a spiral toward the other end surface 24*a*' of the cyclone body 24 from an outside of the other end surface 24*a*' of the cyclone body 24 and then flows into the cyclone chamber 22 of the cyclone body 24 while coming in contact with inner circumferential surfaces of the inner portion 24*b*" and the upper surface 24*ba* of the outer portion 24*b*', or an involute inlet shape (see FIG. 6C) through which the air gradually approaches in the form of a volute toward the inner portion 24*b*" and the upper surface 24*ba* of the outer portion 24*b*' of the body part 24*b* from an outside of the upper surface 24*ba* of the outer portion 24*b*' and then flows into the cyclone chamber 22 of the cyclone body 24 while coming in contact with the inner circumferential surfaces of the inner portion 24*b*" and the upper surface 24*ba* of the outer portion 24*b*'.

Now, an operation of the cyclone dust-separating apparatus 9 according to the first exemplary embodiment of the present embodiment constructed as described above will be explained in detail with reference to FIGS. 1 through 4.

As illustrated in FIGS. 1, 2 and 4, external air is drawn in through the air inlet 28 of the inflow pipe 30 projecting from the side of the cyclone body 24, as indicated by arrow C in FIG. 4. The drawn-in air flows along the inflow pipe 30 and a bendy air flow passage 29 within the cyclone body 24 and moves toward the guide pipe 14 while whirling around the outflow pipe 18, as indicated by arrows A in the drawings. The guide pipe 14 serves to prevent the whirling air from being dispersed from the center of rotation. As illustrated in FIG. 1, dust or dirt 54 laden in the air drops to the dust collecting unit 50 through the dust discharge port 20 as indicated by arrow D of FIG. 4. Although dust or dirt 54, which is heavier than the air, thereby being subjected to higher centrifugal force, drops to the dust collecting unit 50, the air is turned toward the filter 16 by a suction force transferred through the outflow pipe 18 and dust or dirt 54, which has not yet removed from the air, is separated from the air while the air is passing through the filter 16. And then, the air is discharged in a direction (a direction of arrow B) toward a vacuum motor (not illustrated) of the vacuum cleaner through the outflow pipe 18 and the air outlet 26.

If the user wants to dump the dust or dirt collected in the dust collecting unit 50, she or he grips the handle 52 provided on the dust collecting unit 50 and removes the dust collecting unit 50 from the cyclone 10. In addition, if the user wants to clean the filter 16 of the cyclone 10 or the inside of the cyclone chamber 22, she or he removes the filter 16 from the outflow pipe 18 so as to clean the filter 16 or cleans the cyclone chamber 22 through the mounting opening 24*c* formed on the cyclone body 24, after removing the guide unit 11 from the cyclone body 24.

Figure 7:
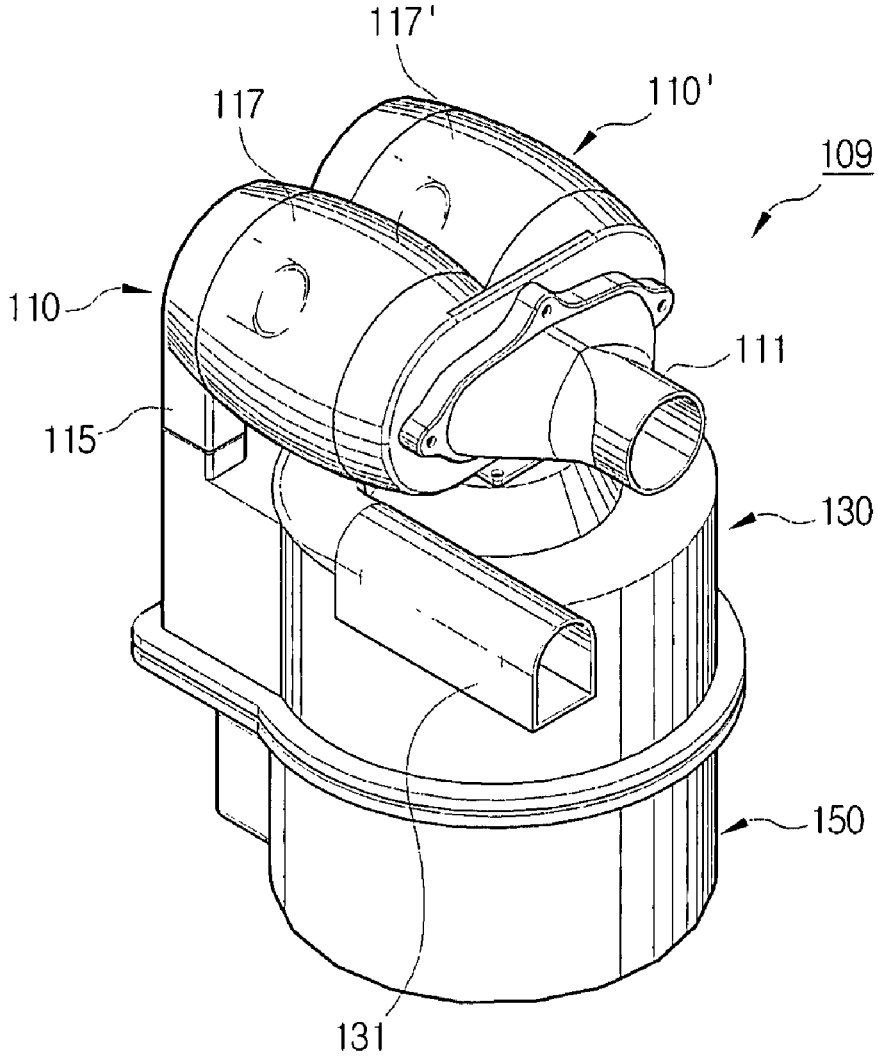
FIG. 7 is a perspective view exemplifying a cyclone dust-separating apparatus of a vacuum cleaner according to a second exemplary embodiment of the present disclosure.
Figure 8:
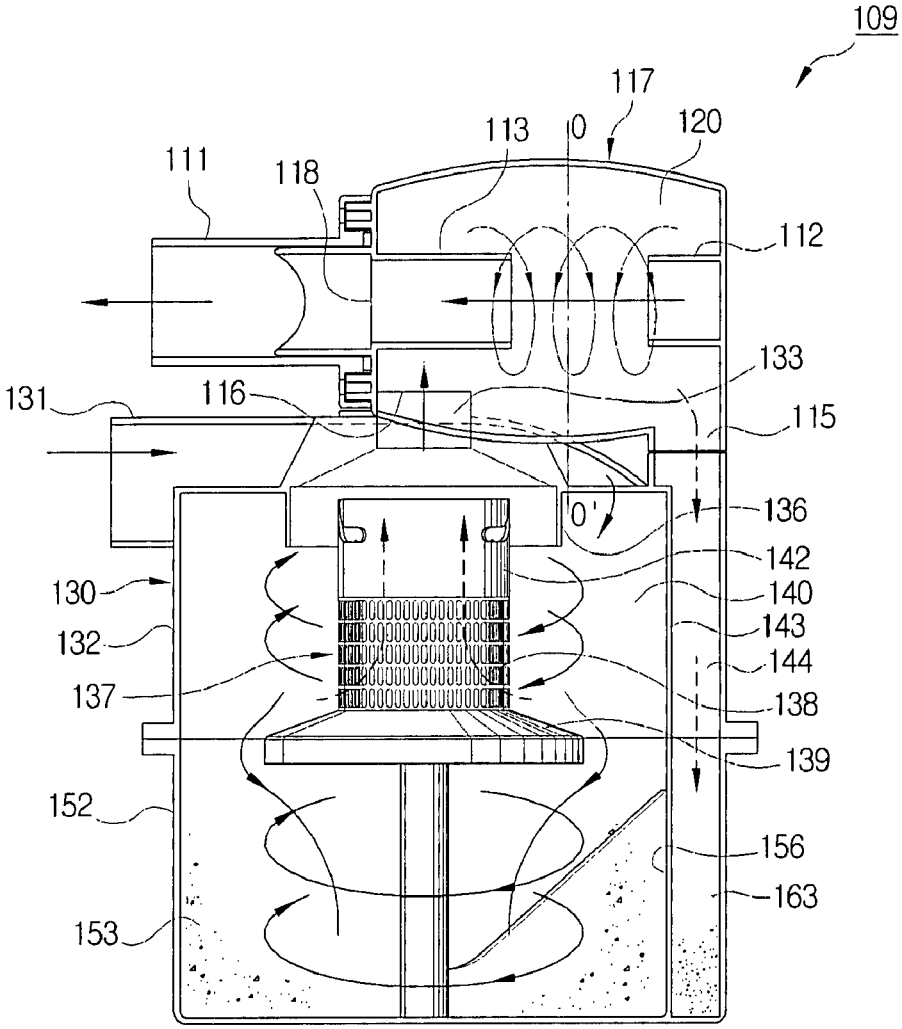
FIG. 8 is a cross-sectional view of the cyclone dust-separating apparatus illustrated in FIG. 7.

FIGS. 7 and 8 exemplify a multi cyclone dust-separating apparatus 109 of a vacuum cleaner according to a second exemplary embodiment of the present disclosure.

As illustrated in FIG. 7, the multi cyclone dust-separating apparatus 109 according to the second exemplary embodiment of the present disclosure includes a first cyclone 130, a plurality of second cyclones 110 and 110' joined to the first cyclone 130 above the first cyclone 130 and horizontally disposed, and a dust collecting unit 150 joined to the first cyclone 130 below the first cyclone 130.

Referring to FIG. 8, the first cyclone 130 is provided with a first cyclone body 132, an inflow pipe 131 to draw in air into the first cyclone body 132, a first air discharging part 133 formed on a top end of the first cyclone body 132, and a grill member 137 joined to the first air discharging part 133.

The first cyclone body 132 at a bottom part hereof is opened, and has the inside divided into a first chamber 140 and a third chamber 144 by a partition 143. The first chamber 140 acts to whirl the drawn-in air, and the third chamber 144 acts to guide dust or dirt flowing into dust discharging tubes 115 of the second cyclones 110 and 110' to a second dust collecting chamber 163 of the dust collecting unit 150, which will be described below.

The first air discharging part 133 is formed on the top end of the first cyclone body 132, and an air guide wall 136 is joined with the first air discharging part 133 and extended downward by a certain distance therefrom. The air guide wall 136 is connected with the inflow pipe 131.

The grill member 137 is provided with a body 138 having a plurality of minute holes formed therein, and a skirt 139 joined to a lower end of the body 138. A top end of the body 138 is joined to the first air discharging part 133. A bottom of the body 138 is blocked, and the skirt 139 is extended around an outer circumferential surface of the lower end of the body 138. The skirt 139 acts to block the dust or dirt centrifugally separated from the air in the first cyclone body 132 from flowing backward.

The two second cyclones 110 and 110' are connected with an outflow pipe 111. The two second cyclones 110 and 110' are disposed side by side in parallel to each other. To move and discharge the air flowing in from the first cyclone 130 in a horizontal direction with a whirling movement, each of the second cyclones 110 and 110' is disposed, so that a center axis line thereof is substantially perpendicular to a center axis line for whirling movement of the first cyclone 130. The second cyclones 110 and 110' include second cyclone bodies 117 and 117', first pipes 112 (only one illustrated) and second pipes 113 (only one illustrated) formed in the second cyclone bodies 117 and 117', air inflow parts 116 (only one illustrated), dust discharging tubes 115 (only one illustrated), and second air discharging parts 118 (only one illustrated) to communicate with the outflow pipe 111, respectively. Since the second cyclones 110 and 110' have the same construction and the same function, only a second cyclone 110 will be described in detail.

The second cyclone body 117 has a second chamber 120 therein to whirl the air flowing in from the first cyclone 130. To assist the air to smoothly form a whirling current, the second pipe 113 and the first pipe 112 are disposed opposite to each other on both ends of the second cyclone body 117, respectively, while having the same center axis.

The second cyclone body 117 is formed in a convex cylinder shape. That is, the second cyclone body 117 can be formed in a shape that two convex cylinder portions, the diameters of which are gradually increased from the both ends to the middle (a line O-O' of FIG. 8) of the second cyclone body 117, respectively, are joined to be symmetrical to each other on the middle of the second cyclone body 117. Alternatively, like the cyclone body 24 of the first embodiment, provided that the diameter of the second cyclone body 117 in the vicinity of an entrance of the second pipe 113, which is an air discharging part to discharge the air, is a maximum diameter, the second cyclone body 117 may be formed in a shape that two convex cylinder portions having different lengths in a direction of longitudinal axis thereof are joined to each other, or a shape that a convex cylinder portion and a linear cylinder portion having the same lengths or different lengths in a direction of longitudinal axis thereof are joined to each other. With this configuration, the air flowing into and through in the second cyclone body 117 does not generate a sudden change in the flow in the vicinity of the entrance of the second pipe 113. As a result, a flowing speed of the air, which is discharged through the outflow pipe 111, is decreased, and thus an operating noise and a pressure loss of the vacuum cleaner are reduced.

The air inflow part 116 is provided on a lower part of the second cyclone body 117 to communicate with the first air discharging part 133 of the first cyclone 130. The air inflow part 116, which draws in the air into the second chamber 120, can be formed in a tangential inlet shape, a helical inlet shape or an involute inlet shape, like the inflow pipe 30 of the first embodiment. The air discharging part 118 is disposed in a tangential direction to the second cyclone body 117 on one side of the second cyclone body 117.

The dust discharging tube 115 is vertically disposed on the other side of the second cyclone body 117, so that it sends minute dust or dirt centrifugally separated from the air in the second cyclone body 117 to the second dust collecting chamber 163 of the dust collecting unit 150 via the third chamber 144 of the first cyclone 130.

The dust collecting unit 150 is detachably joined to a lower part of the first cyclone 130. The dust collecting unit 150, which separately collects and stores relatively large dust or dirt and minute dust or dirt centrifugally separated in the first and the second cyclones 130 and 110, 110', respectively, is configured, so that it is divided into a first dust collecting chamber 153 and a second dust collecting chamber 163 by a partition 156 provided in the a collecting bin body 152.

Hereinafter, an operation of the multi cyclone dust separating apparatus 109 according to the second exemplary embodiment of the present disclosure constructed and described above will be explained in detail with reference to FIGS. 7 and 8.

As illustrated in FIG. 8, air laden with dust or dirt flows into the first cyclone body 132 through the inflow pipe 131. The air is guided by the air guide wall 136 to change into a whirling current, and flows into the first chamber 140 of the first cyclone body 132. Relatively large dust or dirt falls down due to a centrifugal action of the whirling current, and is collected and stored in the first dust collecting chamber 153 of the dust collecting unit 150. Relatively clean air passes through the grill member 137, and comes out to the first air discharging part 133. The air rising through the first air discharging part 133 proceeds into each of the plurality of second cyclone bodies 117 and 117' through the air inflow part 116. Next, the air flows into the second chamber 120 in each of the second cyclone bodies 117 and 117'. The air dashed against the second chamber 120 is formed into a whirling current by the first and the second pipes 112 and 113 in each of the first and the second cyclones 110 and 110', so that dust or dirt is secondly separated from the air. Accordingly, minute dust or dirt, which has not removed from the air in the first cyclone 130, goes out of each of the second cyclones 110 and 110' through the dust discharging tubes 115 due to the centrifugal force, and is collected into and stored in the second dust collecting chamber 163 of the dust collecting unit 150 through the third chamber 144 of the first cyclone 130. And, the whirling current is discharged toward the second air discharging part 118 of each of the second clone bodies 117 and 117' again. The air discharged the second air discharging part 118 is discharged to the outside through the outflow pipe 111.

Figure 9:
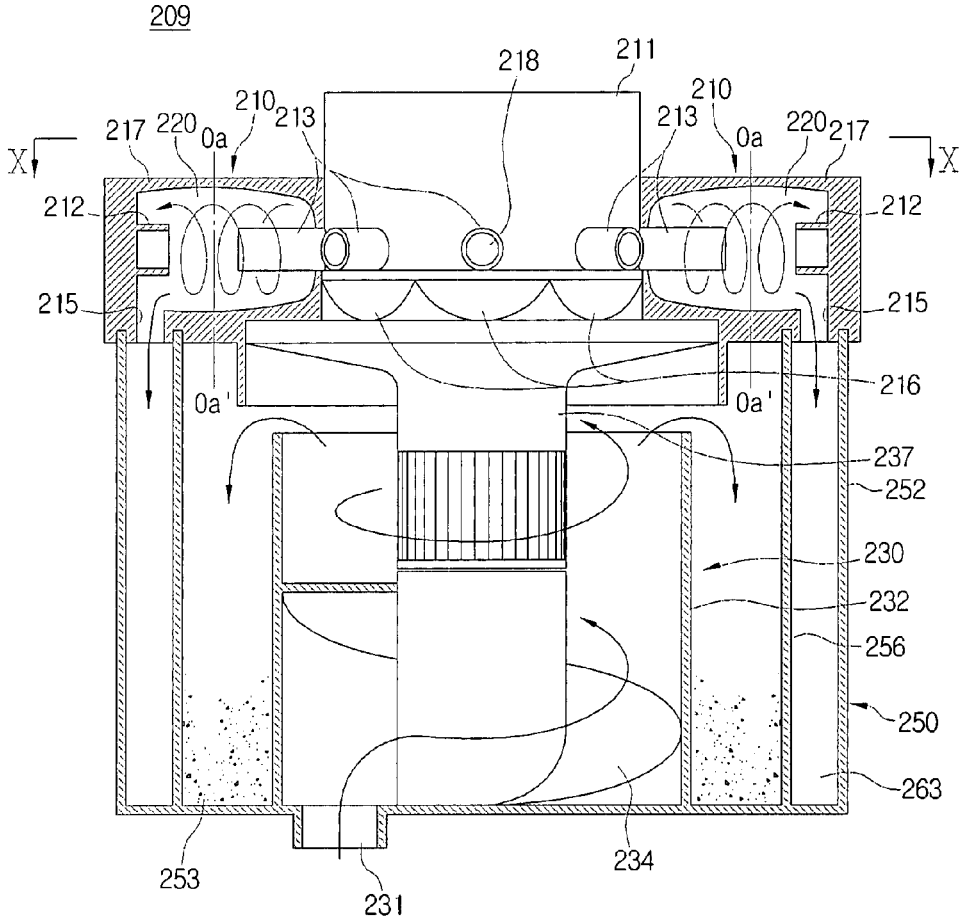
FIG. 9 is a cross-sectional view exemplifying a cyclone dust-separating apparatus of a vacuum cleaner according to a third exemplary embodiment of the present disclosure.

FIG. 9 exemplifies a multi cyclone dust-separating apparatus 209 of a vacuum cleaner according to a third exemplary embodiment of the present disclosure.

As illustrated in FIG. 9, the multi cyclone dust-separating apparatus 209 according to the third exemplary embodiment of the present disclosure includes a first cyclone 230, a plurality of second cyclones 210 horizontally disposed above the first cyclone 230, and a dust collecting unit 250 disposed around the first cyclone 230.

The first cyclone 230 is configured to include a first cyclone body 232 disposed inside the dust collecting unit 250, an inflow pipe 231 to draw in air into the first cyclone body 232, a guide member 234 to guide the air drawn into the first cyclone body 232 to raise in the form of a spiral, and a grill member 237 joined to the guide member 234.

The first cyclone body 232 at an upper part hereof is opened. In the inside of the first cyclone body 232 are disposed the guide member 234 and the grill member 237.

The guide member 234 functions to raise the air into the first cyclone body 232 while whirling in the spiral direction and thus to guide dust or dirt included in the air to a first dust collecting chamber 253 of the dust collecting unit 250 through the upper part of the first cyclone body 232 along an inner circumferential surface of the first cyclone body 232. The grill member 237, in which a plurality of minute holes is formed, is disposed on an upper part of the guide member 234. The grill member 237 draws in air laden with minute dust or dirt, which is not separated from the air by the guide member 234, but remained in the air, and guides it to the plurality of second cyclones 210.

Figure 10:
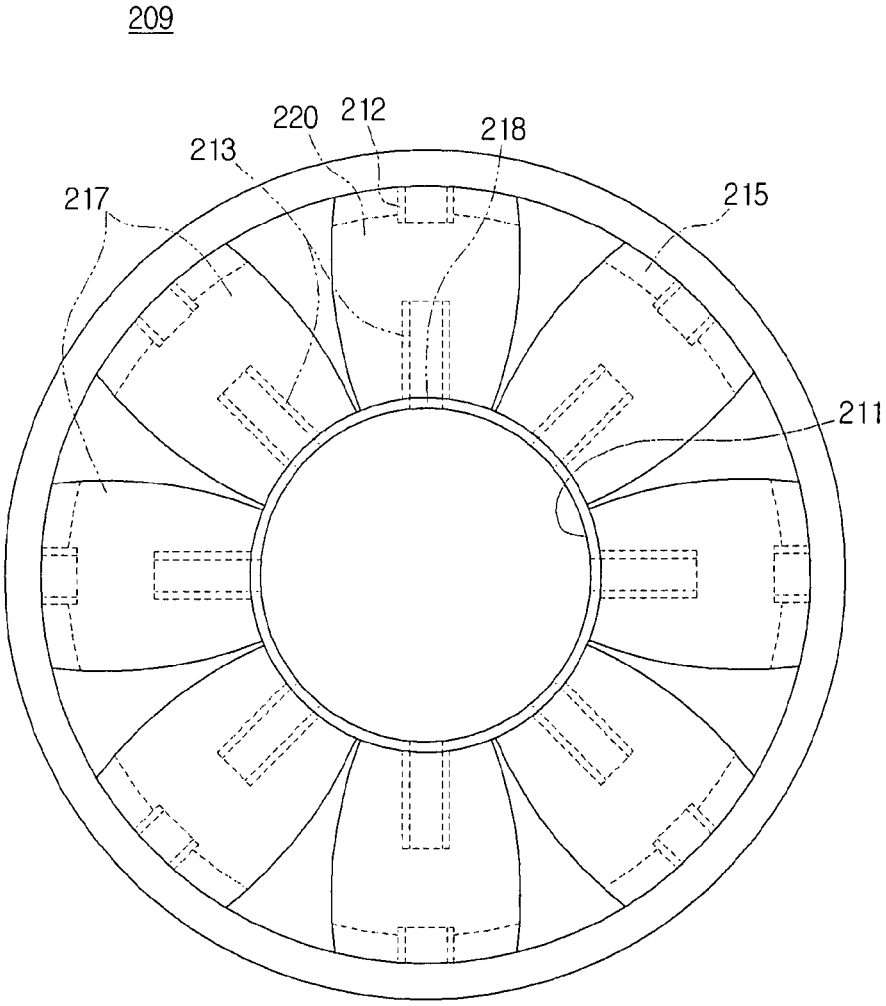
FIG. 10 is a top plan view taken along line X-X of FIG. 9.

As illustrated in FIG. 9, a plurality of, for example, eight second cyclones 210 are radially disposed around the outflow pipe 211, and connected with the outflow pipe 211. Each of the second cyclones 210 include a second cyclone body 217, a first pipe 212 and a second pipe 213 formed in the second cyclone body 217, an air inflow part 216, a dust discharging tube 215, and an air discharging opening 218 (see FIG. 10).

The eight second cyclones 210 are disposed in a radial direction to correspond to the eight air inflow parts 216. Since the eight second cyclones 210 have the same construction and the same function, only a second cyclone 210 will be described in detail.

The second cyclone body 217 has a cyclone chamber 220 therein to whirl the air flowing in from the first cyclone 230. To assist the air to smoothly form a whirling current, the second pipe 213 and the first pipe 212 are disposed opposite to each other on both ends of the second cyclone body 217, respectively, while having the same center axis. The air inflow part 216, which draws in the air into the cyclone chamber 220 of the second cyclone body 217, is communicated with an upper part of the grill member 237, and is radially disposed to correspond to the cyclone chamber 220. Although there is not illustrated, the air inflow part 216 can be formed, so that it is connected in a tangential inlet shape, a helical inlet shape or an involute inlet shape with the second cyclone body 217, like the inflow pipe 30 of the first embodiment.

The second cyclone body 217 is formed in a convex cylinder shape. That is, the second cyclone body 217 can be formed in a shape that two convex cylinder portions, the diameters of which are gradually increased from the both ends to the middle (a line Oa-Oa' of FIG. 9) of the second cyclone body 217, respectively, are joined to be symmetrized to each other on the middle of the second cyclone body 217. Alternatively, like the cyclone body 24 of the first embodiment, provided that the diameter of the second cyclone body 217 in the vicinity of an entrance of the second pipe 213, which is an air discharging part to discharge the air, is a maximum diameter, the second cyclone body 217 may be formed in a shape that two convex cylinder portions having different lengths in a direction of longitudinal axis thereof are joined to each other, or a shape that a convex cylinder portion and a linear cylinder portion having the same lengths or different lengths in a direction of longitudinal axis thereof are joined to each other. With this configuration, the air flows into and moved in the second cyclone body 217 does not generate a sudden change in the flow in the vicinity of the entrance of the second pipe 213. As a result, a flowing speed of the air, which is discharged through the outflow pipe 211, is decreased, and thus an operating nose and a pressure loss of the vacuum cleaner are reduced.

The dust discharging tube 215 is vertically disposed on a side of the second cyclone body 217, so that it sends minute dust or dirt centrifugally separated from the air in the second cyclone body 217 to a second dust collecting chamber 263 of the dust collecting unit 250. The air discharging opening 218 is formed at a lower part of the outflow pipe 211 so as to communicate with the second pipe 213.

The dust collecting unit 250 is detachably joined to a lower part of the second cyclones 210. The dust collecting unit 250, which separately collects and stores relatively large dust or dirt and minute dust or dirt centrifugally separated in the first and the second cyclones 230 and 210, respectively, is configured, so that it is divided into a first dust collecting chamber 253 and a second dust collecting chamber 263 by a partition 256 provided in the a collecting bin body 252.

An operation of the multi cyclone dust-separating apparatus 209 according to the third exemplary embodiment constructed as described above is almost similar to that of the multi cyclone dust-separating apparatus 109 explained with reference to FIGS. 7 and 8. Accordingly, a detailed description on the operation of the multi cyclone dust-separating apparatus 209 will be omitted.

As apparent from the foregoing description, according to the exemplary embodiments of the present disclosure, the cyclone dust-separating apparatus is configured, so that the cyclone body installed in such a manner that the longitudinal axis thereof is substantially horizontally arranged is formed in the convex cylinder shape. Accordingly, the flowing speed of the air at the air discharging part side of the cyclone body is decreased, and thus the operating nose and the pressure loss of the vacuum cleaner are reduced. Such a decrease in the pressure loss reduces the output of the suction motor of the vacuum cleaner, which is required to obtain the same dust-separating efficiency, thereby allowing the vacuum cleaner to use less power.

Although representative embodiments of the present disclosure have been shown and described in order to exemplify the principle of the present disclosure, the present disclosure is not limited to the specific embodiments. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A cyclone dust-separating apparatus comprising:

at least one cyclone unit having a cyclone body, which rotates air to separate dust or dirt therefrom, the cyclone body having an air inflow part and an air discharging part, the cyclone body being arranged in such a manner that a longitudinal axis thereof is substantially horizontally arranged; and a dust collecting unit to store the dust or dirt separated by the at least one cyclone unit, wherein the cyclone body is formed in a convex cylinder shape, so that a diameter thereof in the vicinity of an entrance of the air discharging part through which the air is discharged is a maximum diameter, and wherein the air inflow part is formed in a helical inlet shape through which the air is gradually approached in the form of a spiral toward one end surface of the cyclone body from an outside of the one end surface of the cyclone body and then flowed into the cyclone body while coming in contact with the inner circumferential surface of the cyclone body.

2. The apparatus as claimed in claim 1, wherein the cyclone body comprises at least two convex cylinder portions, the diameters of which are gradually increasing, are joined with each other.

3. The apparatus as claimed in claim 2, wherein the two convex cylinder portions are formed to have the same lengths in a direction of longitudinal axis thereof.

4. The apparatus as claimed in claim 2, wherein the two convex cylinder portions are formed to have different lengths in a direction of the longitudinal axis.

5. The apparatus as claimed in claim 1, wherein the cyclone body comprises at least one linear cylinder portion, the diameter of which is uniform, and at least one convex cylinder portion, the diameter of which gradually increases, are joined with each other.

6. The apparatus as claimed in claim 5, wherein the at least one convex cylinder portion comprises two cylinder portions that have the same lengths in a direction of the longitudinal axis.

7. The apparatus as claimed in claim 5, wherein the at least one convex cylinder portion comprises two cylinder portions that have different lengths in a direction of the longitudinal axis.

8. The apparatus as claimed in claim 1, wherein the air inflow part is formed in a tangential inlet shape through which the air are flowed into the cyclone body while coming in contact directly with an inner circumferential surface of the cyclone body.

9. The apparatus as claimed in claim 1, wherein the at least one cyclone unit comprises a plurality of cyclones disposed in parallel.

10. The apparatus as claimed in claim 1, wherein the at least one cyclone comprises a plurality of cyclones disposed in a radial direction.

11. A cyclone dust-separating apparatus comprising:

at least one cyclone unit having a cyclone body, which rotates air to separate dust or dirt therefrom, the cyclone body having an air inflow part and an air discharging part, the cyclone body being arranged in such a manner that a longitudinal axis thereof is substantially horizontally arranged; and a dust collecting unit to store the dust or dirt separated by the at least one cyclone unit, wherein the cyclone body is formed in a convex cylinder shape, so that a diameter thereof in the vicinity of an entrance of the air discharging part through which the air is discharged is a maximum diameter, and wherein the air inflow part is formed in an involute inlet shape through which the air is gradually approached in the form of a volute toward an outer circumferential surface of the cyclone body from an outside of the outer circumferential surface of the cyclone body and then flowed into the cyclone body while coming in contact with the inner circumferential surface of the cyclone body.

12. The apparatus as claimed in claim 11, wherein the cyclone body comprises at least two convex cylinder portions, the diameters of which are gradually increasing, are joined with each other.

13. The apparatus as claimed in claim 12, wherein the two convex cylinder portions are formed to have the same lengths in a direction of longitudinal axis thereof.

14. The apparatus as claimed in claim 12, wherein the two convex cylinder portions are formed to have different lengths in a direction of the longitudinal axis.

15. The apparatus as claimed in claim 11, wherein the cyclone body comprises at least one linear cylinder portion, the diameter of which is uniform, and at least one convex cylinder portion, the diameter of which gradually increases, are joined with each other.

16. The apparatus as claimed in claim 15, wherein the at least one convex cylinder portion comprises two cylinder portions that have the same lengths in a direction of the longitudinal axis.

17. The apparatus as claimed in claim 15, wherein the at least one convex cylinder portion comprises two cylinder portions that have different lengths in a direction of the longitudinal axis.

18. The apparatus as claimed in claim 11, wherein the at least one cyclone unit comprises a plurality of cyclones disposed in parallel.

19. The apparatus as claimed in claim 11, wherein the at least one cyclone comprises a plurality of cyclones disposed in a radial direction.

* * * * *